United States Patent [19]

Murray et al.

[11] Patent Number: 4,615,689

[45] Date of Patent: Oct. 7, 1986

[54] METHOD FOR PREPARING PAPERLIKE PRODUCTS FROM FIBERS THREADED WITH POLYMER

[75] Inventors: James G. Murray, East Brunswick; Harold G. Tinger, Wayne, both of N.J.

[73] Assignee: Mobil Oil Corporation, New York, N.Y.

[21] Appl. No.: 687,683

[22] Filed: Dec. 31, 1984

[51] Int. Cl.[4] ..... B31B 1/00; B05C 1/00; B27N 3/00

[52] U.S. Cl. ..... 493/51; 156/62.2; 156/62.4; 162/13; 162/168.1; 162/205; 162/206; 162/207; 493/331; 493/332

[58] Field of Search ..... 156/62.2, 62.4; 162/13, 162/205, 168.1, 206, 207; 493/51, 331, 332

[56] References Cited

U.S. PATENT DOCUMENTS

| | | | |
|---|---|---|---|
| 2,739,058 | 3/1956 | O'Flynn et al. | 162/168.1 |
| 3,173,829 | 3/1965 | Thier et al. | 162/168.1 |
| 3,644,251 | 2/1972 | Wilheimi | 162/168.1 |
| 3,804,706 | 4/1974 | Kurashige et al. | 162/168.1 |
| 4,081,318 | 3/1978 | Wietsma | 162/168.1 |
| 4,286,977 | 9/1981 | Klein | 162/168.1 |

*Primary Examiner*—Thurman K. Page
*Attorney, Agent, or Firm*—Alexander J. McKillop; Michael G. Gilman; Edward J. Trojnar

[57] ABSTRACT

Fibers, such as wood fibers, are treated with a solvent solution of a thermoplastic polymer, e.g., polypropylene; the solvent is removed; and the treated fibers are fused into an article such as a fiber-polymer sheet or a board.

16 Claims, No Drawings

METHOD FOR PREPARING PAPERLIKE PRODUCTS FROM FIBERS THREADED WITH POLYMER

CROSS REFERENCE TO RELATED APPLICATIONS

A copending application Ser. No. 566,987 filed Dec. 30, 1983 entitled "Paper-Polymer Product" in the name of James G. Murray, co-inventor herein, describes a method for making a paperlike product by impregnating cellulose fibers with monomer, polymerizing the monomer and forming the treated monomer into sheets.

BACKGROUND OF THE INVENTION

1. Field of the Invention

This invention is directed to a method for preparing a fiber-polymer product from fibers by depositing a polyolefin polymer on the separated fibers. More particularly, the invention is directed to making such a product by depositing a solution of the polymer on the fibers and precipitating the polymer on the fiber. The product can be used in place of paper, paperboard or pulp board in making containers, for example.

2. Description of the Prior Art

U.S. Pat. No. 4,051,214 to Casper et al describes a method for controlling monomer loss during production of a fiber-thermoplastic matrix. A fibrous web is saturated with a liquid vinyl monomer and a free radical initiator is polymerized under controlled conditions. Similarly, U.S. Pat. No. 4,271,227 to Muller et al describes a transparent, resin reinforced fibrous sheet in which monomers are used to fill the voids in the sheet of the fibrous material.

SUMMARY OF THE INVENTION

The method of this invention provides a process for preparing a fiber-polymer product having improved wet-strength and other properties which are particularly advantageous in the production of containers and the like. The process involves treating separated fibers with a solution of a polyolefin polymer in a solvent; precipitating the polyolefin polymer on the fibers; removing the solvent; and heat treating the fibers at a temperature sufficient to fuse the polymer and to form an article.

DETAILED DESCRIPTION OF THE INVENTION

The method of this invention permits the use of inexpensive fiber materials in the preparation of fiber-polymer products containing polyolefin polymer which can be used particularly advantageously in applications in which high wet-strength is desirable, such as in the production of containers. Thus, the products of this invention are suitable for the preparation of paper, paperboard, cardboard, corrugated cardboard, pulp board and the like which can be used for containers or any other article in which wet strength is desirable. For example, cardboard made in accordance with this invention is suitable for fruit containers and containers for beverage cans, both of which are commonly subjected to high humidity or moisture.

A variety of fibers, both natural and synthetic, can be used in the practice of this invention. For example, synthetic fibers such as nylon, polyester, polyacrylonitrile, glass and the like can be used. Similarly, natural inorganic fibers such as asbestos are suitable. However, most preferably, the fibers are cellulose fibers, particularly those derived from wood pulp. An inexpensive material widely available as "fluff", which is mechanically disintegrated wood fiber, and air-laid mats made from such "fluff", are particularly suitable.

The fibers treated in accordance with this invention are in separated form. This includes discreet fibers and fibers which are loosely attached in the form of mats or the like and which can be easily physically separated. This is to distinguish the fibers which are closely bound into paper cardboard sheets or the like.

The polyolefin polymers which are used to treat the fibers in accordance with the method of this invention can broadly comprise any polymer which is soluble in a heated organic solvent and which precipitates upon cooling. Polyolefins such as polypropylene and polyethylene in its various forms have been found to be particularly suitable. Thus, polyprolylene and polyethylenes such as low-pressure polyethylene, linear low density polyethylene, high pressure polyethylene, and various copolymers polyethylene and polypropylene are preferred for use in the method of this invention.

The solvent selected for dissolving polymer to make the solutions for treatment of the fibers depends on the polymer. Aromatic hydrocarbons such as toluene and xylene are advantageously used because they are solvents for the preferred polymers such as polyethylenes and polypropylenes at elevated temperatures. When the temperature is lowered to about 100° C. such polymers precipitate from solution.

The method of this invention is not limited to any manner of applying the polymer to the fibers, nor to any method for removing the solvent from the treated fibers. Thus, a fiber pulp can be slurried with a solution of the polymer in a solvent such as a solution of polyethylene in toluene or xylene and precipitated on the fibers by cooling the slurry. Much of the solvent can be squeezed from the fibers, and the remainder of the solvent can be evaporated off. Also, the fiber wet with a solvent of the polymer can be slurried in water, or treated with steam to remove the solvent.

Similarly the fibers in mat form can be sprayed with, or dipped in a solution on the polymer. The fiber can also be treated with a solution of the polymer in an extruder or similar equipment.

However the polymer treated fiber is obtained, it can be dispersed in water after at least some of the solvent has been removed and deposited to form an article by heat treating, preferably with pressure. Thus the treated fibers can be formed into articles such as sheets on paper-making equipment and fused under suitable pressure and temperature to obtain the desired dry and wet strength properties.

The treated polymer can be formed into sheets without the use of water. Preferably this is accomplished by depositing the polymer on an air-laid mat of the fiber, removing the solvent and treating the polymer coated mat under temperature and pressure conditions sufficient to form a sheet in which the fibers are strongly bonded to one another.

Conditions of treatment can vary widely depending on the polymer used. Generally, using polypropylene as the polymer, formation of the final article is accomplished at temperatures ranging from 100° C. to 225° C. and under pressures of 10 to 2000 psi, preferably 500 to 1000 psi.

Suitable surfactants are advantageously used to assist in the dispersion of the polymer treated fibers in water. Preferably, there are non-ionic surfactants such as the fluorinated surfactants which are commercially available.

It should be recognized that mixtures of fibers either treated or untreated can be used in accordance with this invention. Thus, untreated cellulose fibers can be mixed with polymer treated cellulose fibers and formed on conventional making equipment. Similarly, mixtures of treated fibers can also be used to obtain the specific properties desired.

The invention is illustrated by the following Example in which all parts are by weight unless otherwise specified.

EXAMPLE 1

A pulp fiber mat consisting of separated pulp fibers (13.5 g) was treated with a hot solution (135° C.) of polypropylene (16 g) in xylene (150 ml). On cooling a stiff porous board-like sheet of polymer combined with separate pulp fibers resulted.

Eighty percent of the solvent was removed from this sheet by squeezing the sheet under pressure and the remaining solvent by air drying. (Optionally, solvent can be removed by steam distillation.)

A portion of this sheet was compression molded with heat and pressure into a filled polymeric sheet. The material exhibited good flow of the material during molding due to the lack of strong bonds between the pulp fibers.

A second portion of the pulp-fiber mat was dispersed in a Waring Blender and converted into a paper-like sheet using the TAPPI hand sheet paper forming apparatus.

The resulting paper hand sheet had little strength as formed but was converted into a strong paper like sheet having good physical properties and wet strength by application of heat and pressure to the sheet. Scanning electron microscopy of the sheet before and after hot pressing indicated that the polymer had coalesced around the pulp fibers during the pressing operation leading to the increased strength and physical properties.

Although the present invention has been described with preferred embodiments, it is to be understood that modifications and variations can be restored to without departing from the spirit and scope of this invention, as those skilled in the art will readily understand. Such variations and modifications are considered to be within the purview and scope of the appended claims.

We claim:

1. A method for preparing a film-polymer product comprising the sequential steps of:

(a) treating separated fibers with a heated solvent solution of a polyolefin polymer to coat the fibers;

(b) precipitating the polymer on the fibers by cooling the coated fibers to a temperature at which the polyolefin is not soluble;

(c) removing at least the major portion of the solvent as a liquid;

(d) heat treating the coated fibers at a temperature sufficient to fuse the polymer and to form an article.

2. The method of claim 1 in which said fibers are cellulose fibers.

3. The method of claim 1 in which said article is a sheet.

4. The method of claim 1 in which said article is a container.

5. The method of claim 1 in which said polymer is a polyolefin.

6. The method of claim 1 in which said polymer is a polymer of ethylene or of propylene.

7. The method of claim 1 in which said fibers are in the form of an air-laid mat, the mat is treated with the polyolefin solution, the solvent is removed and the mat is formed into a sheet under heat and pressure.

8. The method of claim 1 in which said polyolefin treated fibers are dispersed in an aqueous medium, formed into a sheet on papermaking equipment, and the sheet treated under heat and pressure.

9. The method of claim 1 in which the fibers are cellulosic fibers, the polyolefin polymer is polypropylene, and said solvent is xylene.

10. The method of claim 1 in which said fibers are wood fiber fluff.

11. The method of claim 9 in which said cellulosic fibers are wood fiber fluff.

12. The method of claim 1 in which said polymer treated fibers are deposited with additional fibers which are not polymer treated.

13. The method of claim 12 in which said additional fibers are cellulosic fibers.

14. The method of claim 12 in which said additional fibers are glass fibers.

15. The method of claim 1 in which the ratio of said polyolefin polymer to said fibers is from 0.1:1 to 2:1.

16. The method of claim 1 in which said step (d) is conducted with the application of pressure.

* * * * *